US007703646B2

(12) United States Patent
Chen

(10) Patent No.: US 7,703,646 B2
(45) Date of Patent: Apr. 27, 2010

(54) CARRYING BAG ADAPTED FOR ACCOMMODATING A WHEELED FOLDABLE ARTICLE OF FURNITURE

(75) Inventor: Shun-Min Chen, Neihu (TW)

(73) Assignee: Wonderland Nursery Goods Co., Ltd, Taipei (TW)

( * ) Notice: Subject to any disclaimer, the term of this patent is extended or adjusted under 35 U.S.C. 154(b) by 1199 days.

(21) Appl. No.: 11/270,254

(22) Filed: Nov. 8, 2005

(65) Prior Publication Data

US 2006/0151560 A1 Jul. 13, 2006

(30) Foreign Application Priority Data

Jan. 13, 2005 (CN) ..... 2005 2 0000577 U

(51) Int. Cl.
*A45F 3/04* (2006.01)
*A45F 4/02* (2006.01)
*A45C 5/14* (2006.01)

(52) U.S. Cl. ..... 224/637; 224/645; 224/654; 224/655; 224/153; 190/18 A

(58) Field of Classification Search ..... 224/637, 224/645, 654, 655, 153; 383/41; 190/18 A
See application file for complete search history.

(56) References Cited

U.S. PATENT DOCUMENTS 5,022,574 A * 6/1991 Cesari ..... 224/153
5,307,908 A * 5/1994 Shyr et al. ..... 190/18 A
5,676,293 A * 10/1997 Farris ..... 224/576
5,743,447 A * 4/1998 McDermott ..... 224/153
6,015,072 A * 1/2000 Young ..... 224/153
6,530,507 B2 * 3/2003 Oh ..... 224/153
7,021,436 B2 * 4/2006 Hoberman et al. ..... 190/18 R

* cited by examiner

*Primary Examiner*—Nathan J Newhouse
*Assistant Examiner*—Lester L Vanterpool
(74) *Attorney, Agent, or Firm*—Quine Intellectual Property Law Group; Gary Baker

(57) ABSTRACT

A carrying bag includes a flexible bag body that defines an accommodation space therein and that has a lower peripheral edge defining a lower access opening. A rigid base member has a periphery configured to matingly engage the lower peripheral edge, and is displaceable relative to the lower peripheral edge between a closed position to close to the lower access opening, and an open position to expose the lower access opening. The base member has holes formed therethrough to be adapted to permit a wheel and a rest of a baby playpen to extend outwardly of the base member for facilitating carrying the playpen. A blocking member is disposed to block the holes so as to permit the bag to receive any other articles.

18 Claims, 6 Drawing Sheets

CARRYING BAG ADAPTED FOR ACCOMMODATING A WHEELED FOLDABLE ARTICLE OF FURNITURE

CROSS-REFERENCE TO RELATED APPLICATION

This application claims priority of Chinese Patent Application No. 2005200005779, filed on Jan. 13, 2005.

BACKGROUND OF THE INVENTION

1. Field of the Invention

This invention relates to a carrying bag, more particularly to a carrying bag adapted for accommodating a wheeled foldable article of furniture so as to facilitate carrying and transport thereof.

2. Description of the Related Art

A conventional wheeled foldable article of furniture, such as a foldable baby playpen, can be carried in a carrying bag after being folded. Since the conventional carrying bag is not designed to permit extension of the wheels of the playpen therethrough, the user has to hand-carry or shoulder-carry the bulky playpen, which is very inconvenient to the user. Moreover, the conventional carrying bag is used only for carrying a foldable baby playpen.

SUMMARY OF THE INVENTION

A main object of the present invention is to provide a carrying bag which can accommodate a wheeled foldable article of furniture, such as a baby playpen, and which permit a wheel of the article to extend through a base member of the carrying bag so as to facilitate carrying and transport of the article.

Another object of the present invention is to provide a carrying bag which can be used as a backpack.

According to this invention, the carrying bag includes a flexible bag body having an upper peripheral edge which defines an upper access opening, a tubular wall which extends from the upper peripheral edge in an upright direction to define an accommodation space therein, and which terminates at a lower peripheral edge that defines a lower access opening. A base member is made from a material more rigid than that of the bag body, has a periphery configured to matingly engage the lower peripheral edge, and is displaceable relative to the lower peripheral edge between a closed position, where the periphery of the base member engages the lower peripheral edge to close the lower access opening, and an open position, where the periphery of the base member disengages from the lower peripheral edge to expose the lower access opening. The base member has a hole unit formed therethrough to be adapted to permit a wheel and a rest of a folded article of furniture to extend outwardly of the base member when the folded article is placed in the accommodation space through the lower access opening and when the base member is displaced to the closed position.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
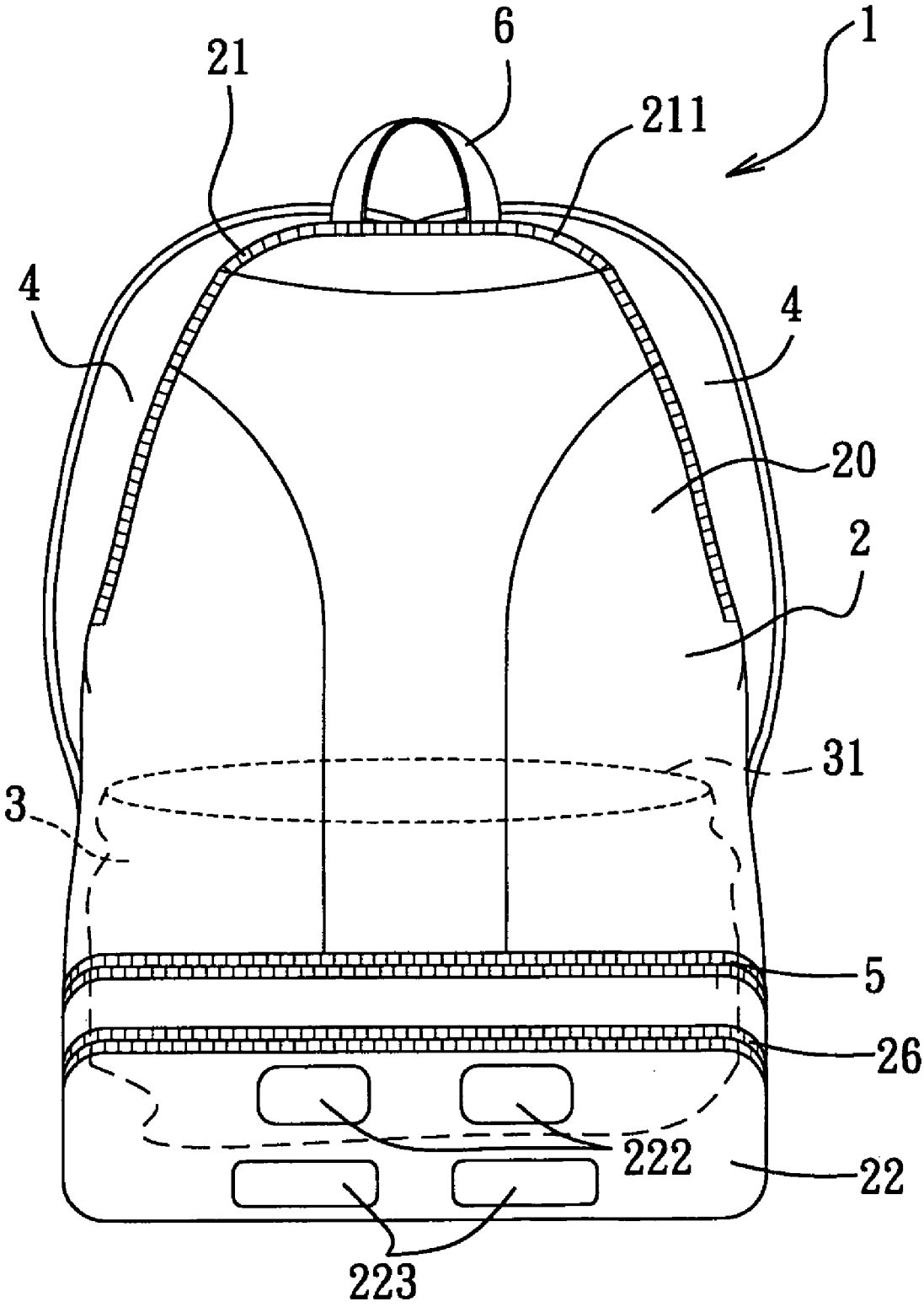
FIG. 1 is a schematic front view of the first preferred embodiment of a carrying bag according to this invention when a base member is in a closed position.

Before the present invention is described in greater detail, it should be noted that same reference numerals have been used to denote like elements throughout the specification.

Figure 2:
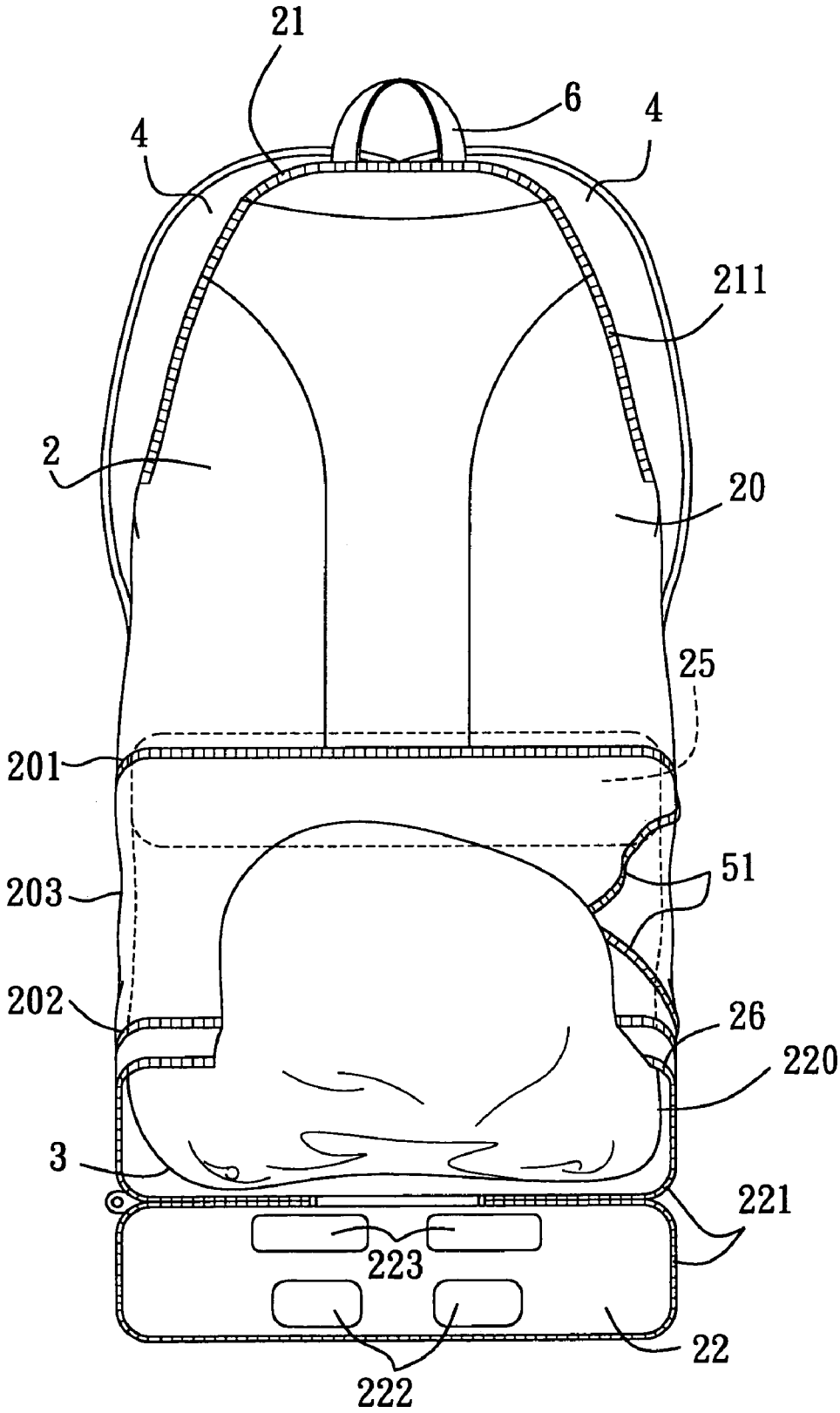
FIG. 2 is a schematic front view of the first preferred embodiment when the base member is in an open position.
Figure 3:
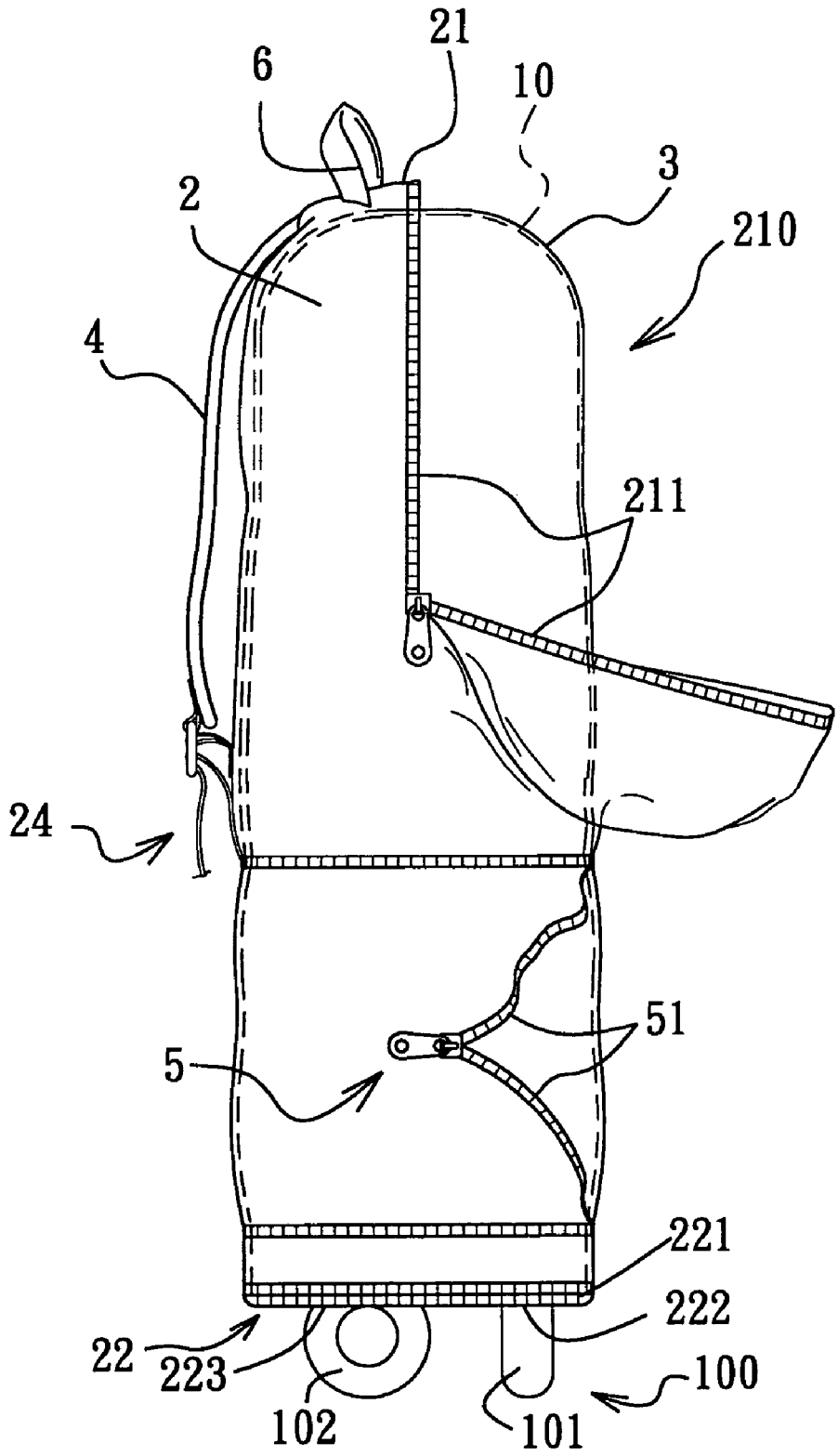
FIG. 3 is a schematic side view of the first preferred embodiment when a baby playpen is accommodated therein.

Referring to FIGS. 1 to 3, the first preferred embodiment of a carrying bag 1 according to the present invention is adapted to accommodate a foldable baby playpen 10. The playpen 10 has a base support 100 which includes a pair of wheels 102 and a pair of rests 101 spaced apart from each other in a longitudinal direction. The rests 101 are movable to be close to the wheels 102 so as to place the playpen 10 in a folded position. The carrying bag 1 is shown to comprise a flexible bag body 2, a base member 22, a blocking member 3, a pair of back straps 4, a collapsing member 5, and a handle 6.

The flexible bag body 2 has an upper peripheral edge 21 which defines an upper access opening 210, a tubular wall 20 which extends downwardly from the upper peripheral edge 21 in an upright direction to define an accommodation space 25 therein, and which terminates at a lower peripheral edge 26 that defines a lower access opening 220. A zipper fastener 211 is disposed along the upper peripheral edge 21 so as to close the upper access opening 210.

The base member 22 is made from a material, such as plastic material, more rigid than that of the bag body 2. The base member 22 has a periphery configured to matingly engage the lower peripheral edge 26, and is displaceable relative to the lower peripheral edge 26 between a closed position, as shown in FIG. 1, where the periphery of the base member 22 engages the lower peripheral edge 26 to close the lower access opening 220, and an open position, as shown in FIG. 2, where the periphery of the base member 22 disengages from the lower peripheral edge 26 to expose the lower access opening 220. A zipper fastener 221 is disposed between the lower peripheral edge 26 and the periphery of the base member 22 and is operable to place the base member 22 in the closed position or the open position. The base member 22 has a pair of first holes 223 and a pair of second holes 222 which are formed therethrough, which are opposite to each other in the longitudinal direction in the closed position, and which are configured to be adapted to respectively permit the wheels 102 and the rests 101 of the playpen 10 to extend outwardly of the base member 22 when the playpen 10 is placed in the accommodation space 25 through the lower access opening 220 and when the base member 22 is displaced to the closed position.

In this embodiment, the blocking member 3 is a flexible sack which is formed from a flexible sheet that is disposed in the accommodation space 25. The flexible sheet has a periphery 31 connected to the tubular wall 20, and upper and lower wall surfaces confronting the upper and lower access openings 210, 220, respectively. The flexible sheet is displaceable (deformable) relative to the base member 22 between an unblocking position, as shown in FIG. 3, where the flexible sheet is pushed upwardly to be kept away from the first and second holes 223, 222 so as to permit the outward extension of the wheels 102 and the rests 101 of the playpen 10 received in the accommodation space 25 through the first and second holes 223, 222, and a blocking position, as shown in FIG. 1, where the flexible sheet is pushed downwardly to be superimposed upon the base member 22 and to block the first and second holes 223, 222 so as to prevent the outward extension of the playpen 10 and other objects received in the accommodation space 25.

The tubular wall 20 of the bag body 2 has upper and lower attached zones 201, 202 spaced apart from each other in the upright direction by a collapsible area 203. The collapsing member 5 includes a zipper fastener 51 which is connected to the upper and lower attached zones 201, 202, and which enables conversion of the collapsible area 203 from a spread position, as shown in FIG. 3, where the upper and lower attached zones 201, 202 are remote from each other, to a collapsed position, as shown in FIG. 1, where the upper and lower attached zones 201, 202 are in proximity to each other.

The handle 6 is disposed on the upper peripheral edge 21 of the bag body 2. The back straps 4 are attached to a rear side 24 of the tubular wall 20 of the bag body 2.

In use, when the base member 22 is in the open position, the folded playpen 10 is placed in the accommodation space 25 through the lower access opening 220 so as to spread the blocking member 3 upwardly to the unblocking position, thereby permitting the wheels 102 and the rests 101 to extend outwardly. The base member 22 is then moved to the closed position with the zipper fastener 221 so as to permit outward extension of the wheels 102 and the rests 101 through the first and second holes 223, 222. Thus, the user can grip the handle 6 to pull/push the playpen 10 along by means of the wheels 223.

Moreover, when it is desired to store the playpen 10 in the accommodation space 25 without exposing the wheels 102 and the rests 101, the playpen 10 is put inside the carrying bag 1 through the upper access opening 210 such that the blocking member 3 is pushed downwardly to the blocking position so as to block the first and second holes 223, 222. Hence, the carrying bag 1 can also be used as a backpack to carry any other articles concealing. Furthermore, due to the arrangement of the collapsing member 5, the carrying bag 1 can be reduced in length if desired so as to facilitate carrying on the back.

It is noted that the number and size of the first and second holes 223, 222 can be varied to suit playpens of varying size and design, such as that having four wheels, and that having four rests, etc.

Figure 4:
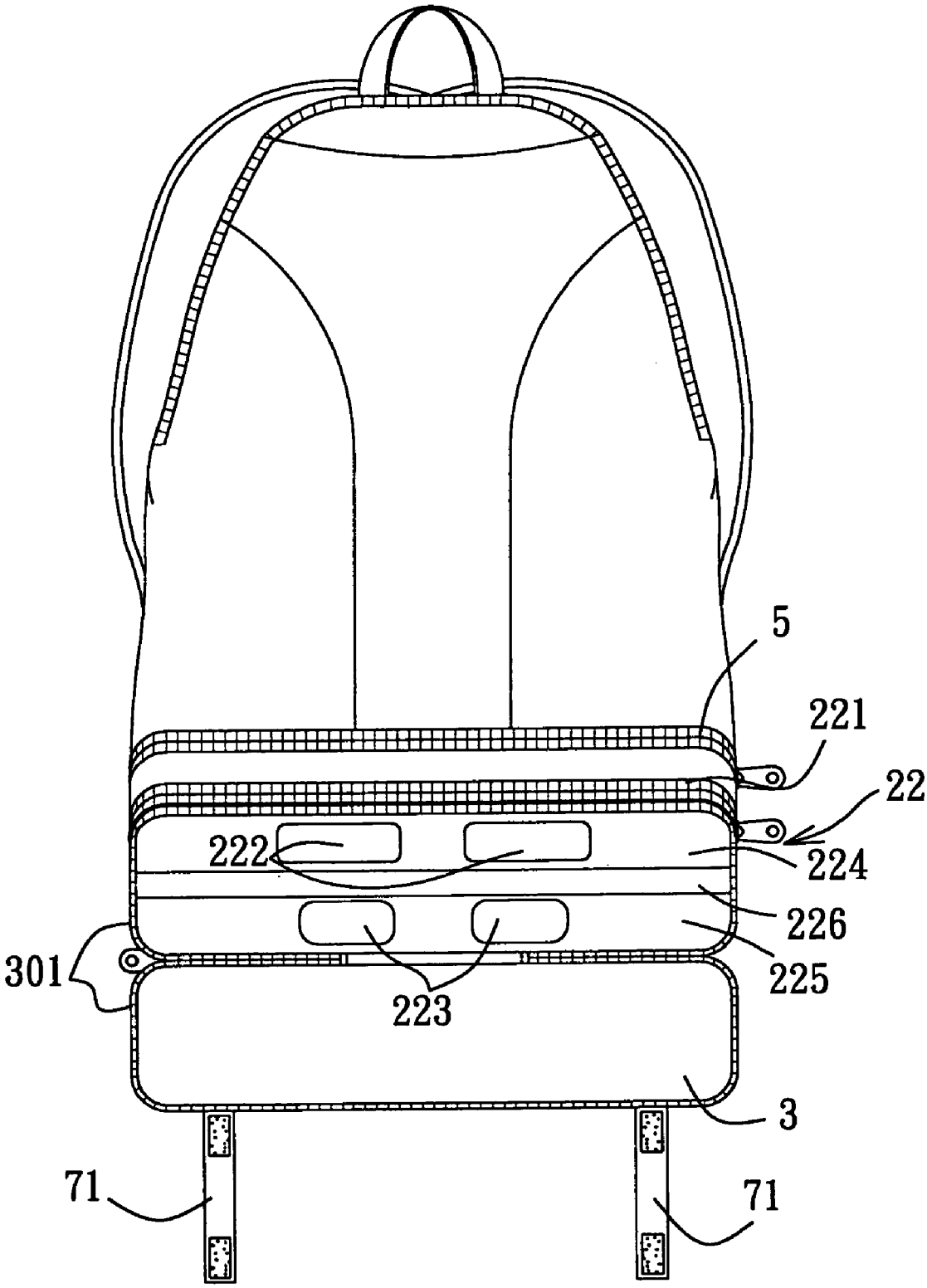
FIG. 4 is a schematic front view of the second preferred embodiment of a carrying bag according to this invention when a cover sheet is in an unblocking position.
Figure 5:
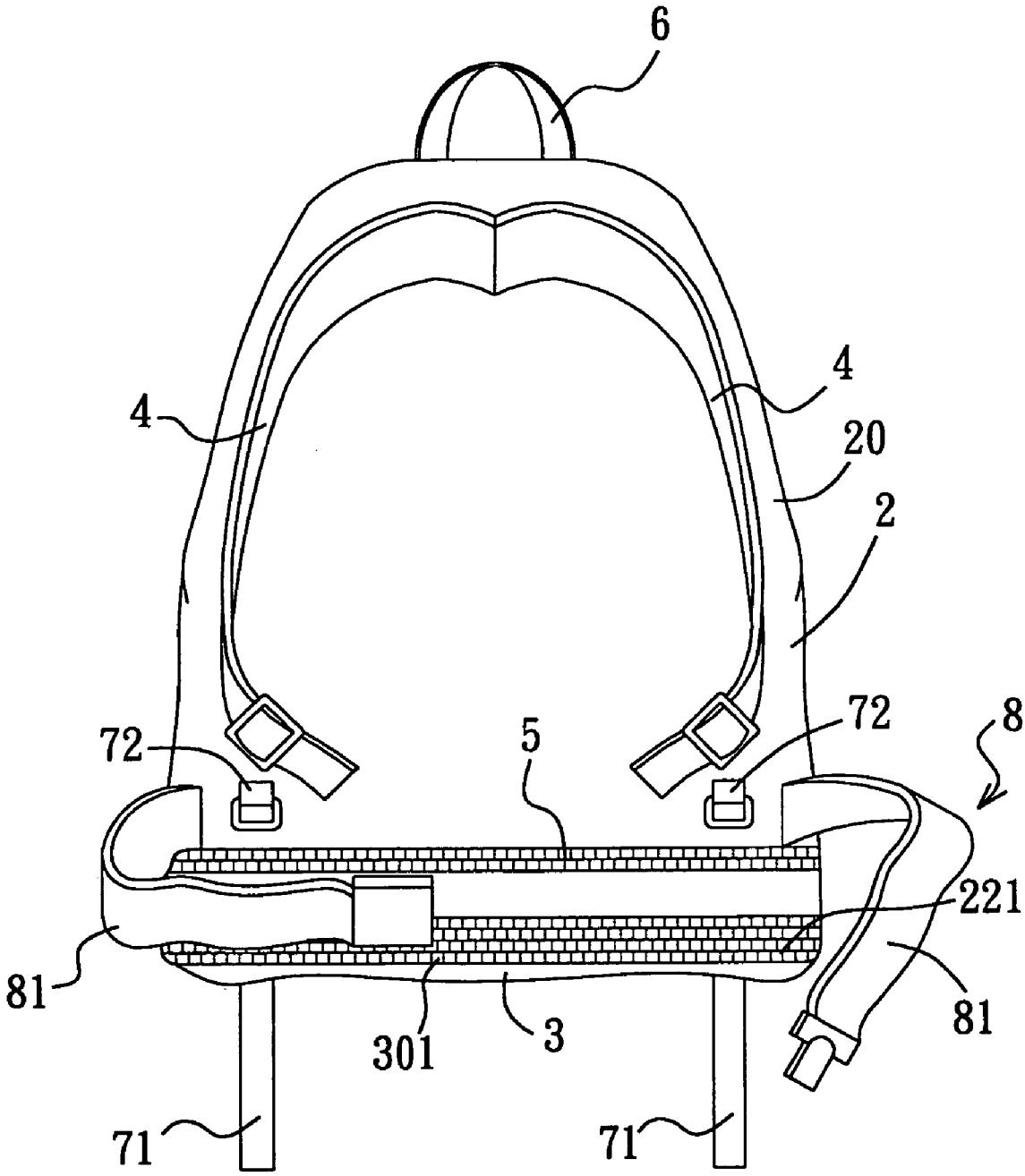
FIG. 5 is a schematic rear view of the second preferred embodiment when the cover sheet is in a blocking position.
Figure 6:
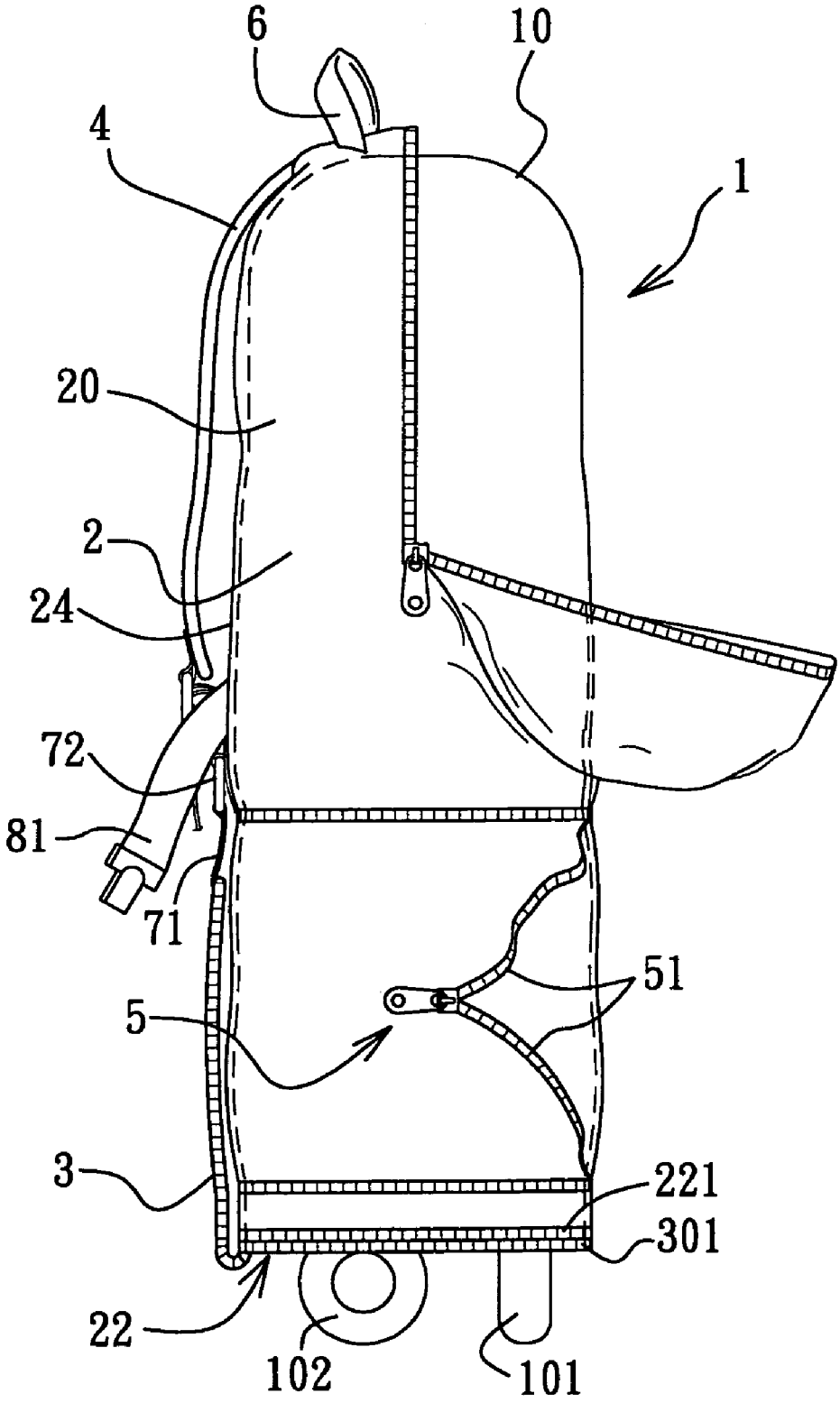
FIG. 6 is a schematic side view of the second preferred embodiment when a baby playpen is accommodated therein.

Referring to FIGS. 4 to 6, the second preferred embodiment of a carrying bag according to this invention is shown to be similar to the first preferred embodiment in construction. The differences reside in that the blocking member 3 is a cover sheet 3 which is detachably connected to the base member 22 and which is disposed beneath the base member 22 so as to block the first and second holes 223, 222 in the blocking position. A zipper fastener 301 is disposed between the lower peripheral edge of the bag body 2 and the cover sheet 3 to fasten the cover sheet 3 in the blocking position. Further, the base member 22 includes a first rigid sheet 224, a second rigid sheet 225, and a flexible spacer 226 which is interposed therebetween and which is configured to permit the first and second rigid sheets 224, 225 to be superimposed upon each other, thereby reducing the size of the carrying bag 1 for storage. Furthermore, the presence of the first and second rigid sheets 224, 225 can increase the strength of the carrying bag.

Moreover, two ring fasteners 72 are disposed on the rear side 24 of the bag body 2 proximate to the base member 22. Two straps 71, which have hooks-and-loops fasteners, are secured to the cover sheet 3 such that each of the straps 71 passes through the respective ring fastener 72 to fasten the cover sheet 3 to the rear side 24 of the bag body 2 so as to position the cover sheet 3 in the unblocking position.

Furthermore, a fastening belt 8 includes two belt segments 81 which are attached to the tubular wall 20 of the bag body 2, and can be fastened around the waist of the user when the carrying bag 1 is carried on the back of the user.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A carrying bag for accommodating a foldable article of furniture which has a wheel and a rest spaced apart from each other in a longitudinal direction, the rest being movable to be close to the wheel so as to place the article in a folded position, said carrying bag comprising:

a flexible bag body having an upper peripheral edge which defines an upper access opening, and a tubular wall which extends from said upper peripheral edge in an upright direction to define an accommodation space therein, and which terminates at a lower peripheral edge that defines a lower access opening; and a base member which is made from a material more rigid than that of said bag body, which has a periphery configured to matingly engage said lower peripheral edge, and which is displaceable relative to said lower peripheral edge between a closed position, where said periphery of said base member engages said lower peripheral edge to close said lower access opening, and an open position, where said periphery of said base member disengages from said lower peripheral edge to expose said lower access opening, said base member having a hole unit which is formed therethrough, and which is configured to permit at least one of the wheel and the rest of the folded article to extend outwardly of said base member when the folded article is placed in said accommodation space through said lower access opening and when said base member is displaced to the closed position.

2. The carrying bag of claim 1, wherein said hole unit includes first and second holes which are opposite to each other in the longitudinal direction in the closed position, and which are configured to be adapted to respectively permit the wheel and the rest of the folded article to extend outwardly of said base member.

3. The carrying bag of claim 1, further comprising a blocking member which is displaceable relative to said base member between an unblocking position, where said blocking member is kept away from said hole unit so as to permit the outward extension of the wheel and the rest of the folded article received in said accommodation space through said hole unit, and a blocking position, where said blocking member blocks said hole unit so as to prevent the outward extension of the folded article received in said accommodation space.

4. The carrying bag of claim 3, wherein said blocking member is a flexible sack which is formed from a flexible sheet that has a periphery connected to said tubular wall, and that has upper and lower wall surfaces confronting said upper and lower access openings, respectively, said flexible sheet being dimensioned so as to be superimposed upon said base member when pushed downwardly so as to place said flexible sack in the blocking position.

5. The carrying bag of claim 3, wherein said blocking member is a cover sheet which is detachably connected to said base member and which is disposed beneath said base member so as to block said hole unit in the blocking position.

6. The carrying bag of claim 5, further comprising a zipper fastener disposed between said periphery of said base member and said cover sheet to fasten said cover sheet in the blocking position.

7. The carrying bag of claim 5, further comprising a fastener disposed to position said cover sheet to said tubular wall of said bag body in the unblocking position.

8. The carrying bag of claim 1, wherein said base member includes a first rigid sheet, a second rigid sheet, and a flexible spacer interposed therebetween and configured to permit said first and second rigid sheets to be superimposed upon each other.

9. The carrying bag of claim 1, further comprising a zipper fastener disposed to close said upper access opening.

10. The carrying bag of claim 1, further comprising a handle disposed on said upper peripheral edge of said bag body.

11. The carrying bag of claim 1, further comprising a pair of back straps attached to said tubular wall of said bag body.

12. The carrying bag of claim 1, further comprising a fastening belt attached to said tubular wall of said bag body and adapted to be fastened around the waist of the user.

13. The carrying bag of claim 1, wherein said tubular wall has upper and lower, attached zones spaced apart from each other in the upright direction by a collapsible area, said carrying bag further comprising a collapsing member which is connected to said upper and lower attached zones and which enables conversion of said collapsible area from a spread position, where said upper and lower attached zones are remote from each other, to a collapsed position, where said upper and lower attached zones are in proximity to each other.

14. The carrying bag of claim 13, wherein said collapsing member is in form of a zipper fastener.

15. The carrying bag of claim 3, wherein said tubular wall has upper and lower attached zones spaced apart from each other in the upright direction by a collapsible area, said carrying bag further comprising a collapsing member which is connected to said upper and lower attached zones and which enables conversion of said collapsible area from a spread position, where said upper and lower attached zones are remote from each other, to a collapsed position, where said upper and lower attached zones are in proximity to each other.

16. A foldable article of furniture comprising:

an article body which has a wheel and a rest spaced apart from each other in a longitudinal direction, said rest being movable to be closer to said wheel so as to place said article body in a folded position; and a carrying bag for accommodating said article body, and including:

a flexible bag body having an upper peripheral edge which defines an upper access opening, and a tubular wall which extends from said upper peripheral edge in an upright direction to define an accommodation space therein, and which terminates at a lower peripheral edge that defines a lower access opening, and a base member which is made from a material more rigid than that of said bag body, which has a periphery configured to matingly engage said lower peripheral edge, and which is displaceable relative to said lower peripheral edge between a closed position, where said periphery of said base member engages said lower peripheral edge to close said lower access opening, and an open position, where said periphery of said base member disengages from said lower peripheral edge to expose said lower access opening, said base member having a hole unit which is formed therethrough, and which is configured to permit at least one of said wheel and said rest of said article body to extend outwardly of said base member when said article body is placed in said accommodation space through said lower access opening and when said base member is displaced to the closed position.

17. A carrying bag for accommodating a foldable article of furniture which has a wheel, and other articles, said carrying bag comprising:

a flexible bag body having an upper peripheral edge which defines an upper access opening, and a tubular wall which extends from said upper peripheral edge in an upright direction to define an accommodation space therein, and which terminates at a lower peripheral edge that defines a lower access opening;

a base member which has a periphery configured to matingly engage said lower peripheral edge, and a hole unit which is formed therethrough, and which is configured to be adapted to permit the wheel of the folded article to extend outwardly of said base member when the folded article is placed in said accommodation space through said lower access opening; and a blocking member which is displaceable relative to said base member between an unblocking position, where said blocking member is kept away from said hole unit so as to permit the outward extension of the wheel of the folded article received in said accommodation space through said hole unit, and a blocking position, where said blocking member blocks said hole unit so as to permit the other articles to be received and retained in said accommodation space.

18. The foldable article of claim 16, comprising a blocking member which is displaceable relative to said base member between an unblocking position, where said blocking member is kept away from said hole unit so as to permit the outward extension of the wheel and the rest of the folded article received in said accommodation space through said hole unit; and a blocking position, where said blocking member blocks said hole unit so as to prevent the outward extension of the folded article received in said accommodation space.

* * * * *